United States Patent [19]

Hale

[11] Patent Number: 4,789,807

[45] Date of Patent: Dec. 6, 1988

[54] ELECTRON GUN ASSEMBLY HAVING A REINFORCED HEATER TAB

[75] Inventor: John R. Hale, East Hempfield Township, Lancaster County, Pa.

[73] Assignee: RCA Licensing Corp., Princeton, N.J.

[21] Appl. No.: 91,168

[22] Filed: Aug. 31, 1987

[51] Int. Cl.[4] ..... H01J 29/46; H01J 1/94

[52] U.S. Cl. ..... 313/446; 313/337; 313/269; 313/270; 313/456

[58] Field of Search ..... 313/446, 337, 269, 270, 313/456, 457, 37, 346 R

[56] References Cited

U.S. PATENT DOCUMENTS

| | | | |
|---|---|---|---|
| 3,555,640 | 1/1971 | Lundvall, II | 29/25.16 |
| 3,973,163 | 8/1976 | Collins | 313/446 X |
| 4,049,991 | 9/1977 | Collins | 313/417 |
| 4,251,746 | 2/1981 | Kawamura et al. | 313/345 |
| 4,403,169 | 9/1983 | Blanken | 313/446 |
| 4,484,102 | 11/1984 | Hale | 313/417 |
| 4,486,685 | 12/1984 | Hale et al. | 313/457 X |
| 4,523,124 | 6/1985 | Blanken et al. | 313/446 |
| 4,595,858 | 6/1986 | Hale | 313/414 |

*Primary Examiner*—David K. Moore
*Assistant Examiner*—Michael Horabik
*Attorney, Agent, or Firm*—Eugene M. Whitacre; Dennis H. Irlbeck; Vincent J. Coughlin, Jr.

[57] ABSTRACT

An electron gun assembly for use in a CRT includes a pair of insulating support rods, at least one indirectly heated cathode disposed between the support rods, a heater for the cathode and an improved heater tab. The heater includes a pair of heater legs which are attached to the heater tab. Heater bead straps are provided for attaching the heater tab to the support rods. The electron gun also includes a plurality of electrodes for focusing and accelerating an electron beam generated by the cathode. The improved heater tab comprises a main body portion including a first and a second part. Each of the parts is attached to one of the heater legs. The heater tab has a pair of outwardly directed feet each of which is connected to one of the parts of the main body portion by a pair of substantially orthogonal legs extending therebetween. The heater tab includes reinforcing gussets extending between the parts of the main body portion and the legs and between the legs and the feet to maintain the rigidity of the heater tab.

4 Claims, 2 Drawing Sheets

ELECTRON GUN ASSEMBLY HAVING A REINFORCED HEATER TAB

BACKGROUND OF THE INVENTION

The invention relates to an electron gun assembly having a reinforced heater tab which minimizes cathode-ray tube failure caused by a shorted heater tab.

U.S. Pat. No. 3,555,640 issued to Lundvall on Jan. 19, 1971 discloses a method for mounting a heater within a tubular cathode. A U-shaped tab is welded to the legs of the heater, and a transverse portion of the tab is removed after the heater is positioned within the tubular cathode. The removal of the transition portion electrically isolates the arms of the tab so that the heater can be energized. The tab is shown as substantially flat; however, a step-like offset of the heater tab is shown in U.S. Pat. No. 4,523,124 issued to Blanken et al. on June 11, 1985. The off-set facilitates centering of the heater within the tubular cathode and permits thermal expansion of the tab structure during tube operation but provides little structural strength.

A conventional heater tab 10 hereinafter referred to as a conformal tab is shown in FIG. 1*a*. The conformal tab 10 comprises a main body portion 12 including a first part 14 and a second part 16 which are temporarily connected, during electron gun construction, by a removal portion 18 located below a score line 19. As shown in FIG. 1*b*, the conformal tab 10 includes a pair of outwardly directed feet 20 each of which is connected to the parts 14 and 16 of the main body portion 12 by substantially orthogonal legs 22 extending therebetween. A pair of heater legs 24 for a heater 25 are attached, for example by welding, to the parts 14 and 16. A problem with the conformal tab 10 is that sufficient transverse motion of the parts 14 and 16 in the direction A-A, subsequent to the removal of portion 18, can cause the parts 14 and 16 to contact one another and short-out the heater. Thus, there is a need for a reinforced heater tab that is structurally strong yet easily weldable to support components within the electron gun assembly.

SUMMARY OF THE INVENTION

An electron gun assembly for use in a cathode-ray includes a pair of insulating support rods, at least one indirectly heated cathode disposed between the support rods, a heater for the cathode and an improved heater tab. The heater has a pair of heater legs. Strap means are provided for attaching the heater tab to the support rods. The electron gun also includes a plurality of electrodes for focusing and accelerating an electron beam generated by the cathode. The improved heater tab comprises a main body portion including a first and a second part. Each of the parts is attached to one of the heater legs. The heater tab has a pair of outwardly directed feet each of which is connected to one of the parts of the main body portion by a pair of substantially orthogonal legs extending therebetween. The heater tab includes reinforcing means extending between the parts of the main body portion and the legs and between the legs and the feet to maintain the rigidity of the heater tab.

DETAILED DESCRIPTION OF THE PREFERRED EMBODIMENT

Figure 2:
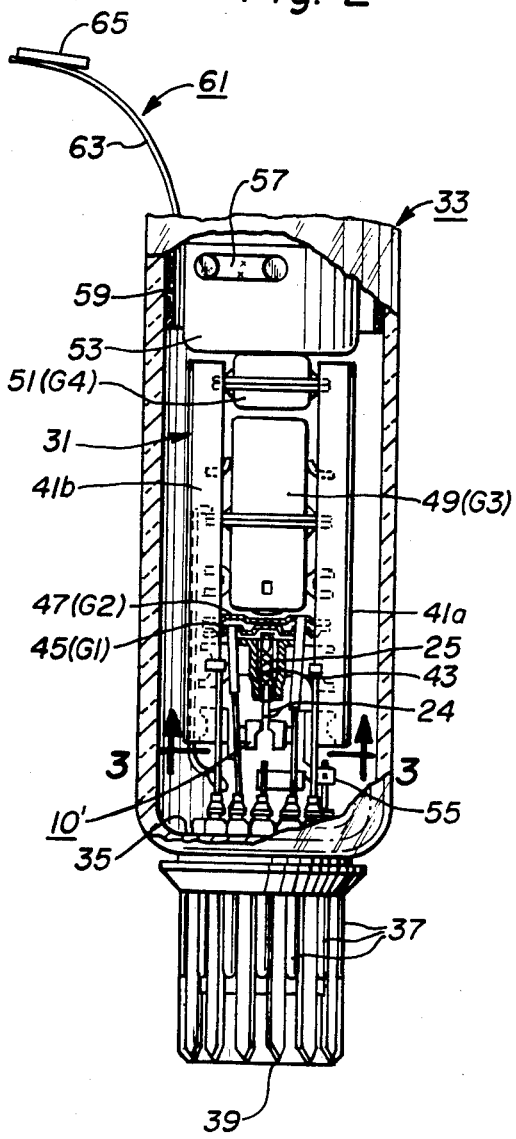
FIG. 2 is a broken-away, front elevational view of an electron gun assembly incorporating the present invention.

FIG. 2 shows structural details of an inline electron gun assembly 31 mounted in the neck 33 of a cathode-ray tube, CRT. The structure of this electron gun is similar to the electron gun assembly described in U.S. Pat. No. 4,484,102 issued to J.R. Hale on Nov. 20, 1984 which is assigned to the assignee of the present patent application, and is incorporated by reference herein for the purpose of disclosure.

The CRT includes an evacuated glass envelope having a rectangular faceplate panel (not shown) and a funnel (also not shown) with the neck 33 integrally attached thereto. A glass stem 35 having a plurality of leads or pins 37 extending therethrough is sealed to and closes the end of the neck 33. A base 39 is attached to the stem 35 and serves to locate the pins 37.

The inline electron gun assembly 31 is centrally mounted within the neck 33 and is designed to generate and direct three electron beams along spaced, co-planar convergent paths toward a screen (not shown) on the faceplate panel. The gun assembly comprises two insulating glass support rods 41*a* and 41*b* from which various electrodes are supported to form a coherent unit in a manner well known in the art. These electrodes include three substantially equally transversely-spaced co-planar indirectly heated cathodes 43 (one for producing each beam), a control grid electrode 45 (also referred to as G1), a screen grid electrode 47 (also referred to as G2), a first accelerating and focusing electrode 49 (also referred to as G3), a second accelerating and focusing electrode 51 (also referred to as G4), and a shield cup 53, longitudinally spaced in the order name along the support rods 41*a* and 41*b*. The various electrodes of the gun assembly 31 are electrically connected to the pins 37 either directly or through metal ribbons 55. The gun assembly 31 is centered within the neck 33 by snubbers 57 on the shield cup 53 which press on and make contact with an electrically conductive internal coating 59 on the inside surface of the neck 33. The internal coating 59 extends over the inner surface of the funnel and connects to an anode button (not shown). A getter assembly 61 comprises an elongated spring 63 which is attached at one end to the cup 53 and extends in cantilever fashion in the funnel of the envelope. A metal getter container 65 is attached to the other extended end of the spring 63.

The three cathodes 43 are substantially identical and comprise a cylinder closed at one end by a cap with a suitable electron emissive coating thereon. A heater 25 having a pair of heater legs 24 is disposed within each of the cathodes 43. The heater legs are attached, for example by welding to a plurality of heater tabs.

Figure 1A:
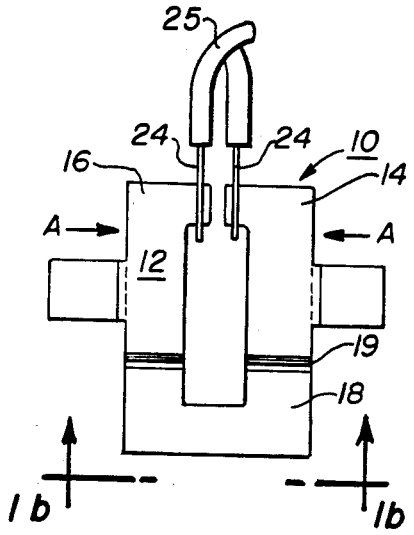
Fig. 1a Prior Art
FIGS. 1*a* and 1*b* are plan and bottom views, respectively, of a conventional conformal heater tab during electron gun construction.
Figure 1B:
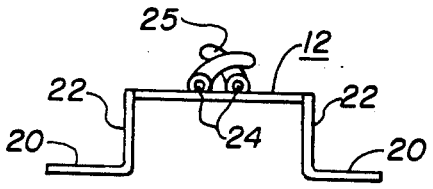
Fig. 1b Prior Art
Figure 3:
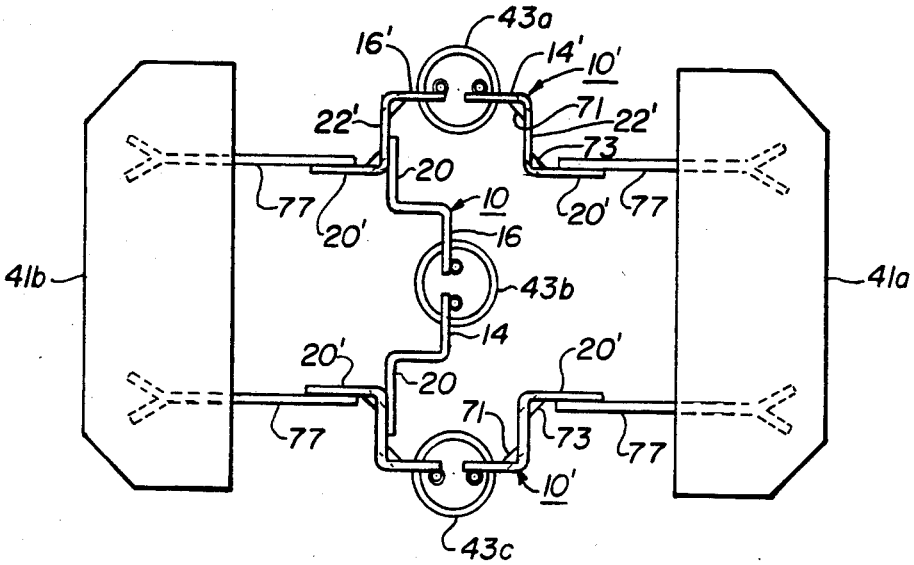
FIG. 3 is a bottom view along section line 3—3 showing nested heater tabs of the electron gun of FIG. 2.
Figure 4A:
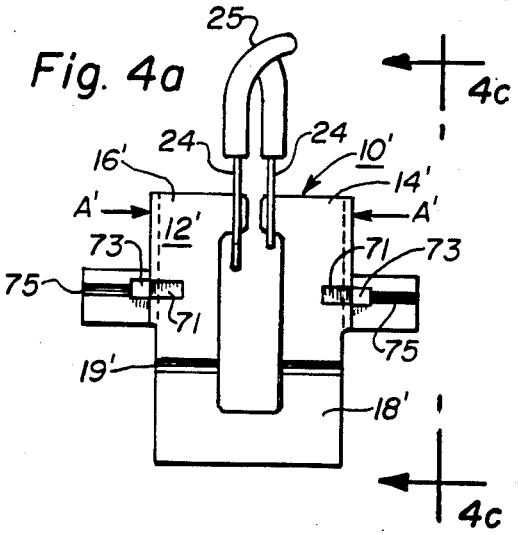
FIGS. 4*a*, 4*b* and 4*c* are plan, bottom and side views, respectively, of the heater tab of the present invention during electron gun construction.

As shown in FIG. 3, a pair of reinforced heater tabs 10' are associated with the outer cathodes 43*a* and 43*c* and a conventional, conformal heater tab 10 is associated with the center cathode 43*b*. With respect to FIGS. 4*a*, 4*b* and 4*c*, the reinforced heater tab 10' is similar to the conformal heater tab 10 (FIGS. 1*a* and 1*b*) and corresponding elements of the reinforced tab are designated by a prime. The reinforced heater tab 10' comprises a main body portion 12' including a first part 14' and a second part 16' which are temporarily connected during electron gun construction by a removal portion 18' located below a score line 19'. The reinforced tab 10' has a pair of outwardly directed feet 20' each of which is connected to one of the parts 14' and 16' of the main body portion 12' by substantially orthogonal legs 22' extending therebetween. The reinforced heater tab 10' is different from the conformal tab 10 in that the reinforced tab 10' includes a first pair of oppositely disposed gussets 71 formed between the two parts 14' and 16' of the main body portion 12' and the legs 22', and a second pair of oppositely disposed gussets 73 formed between the legs 22' and the feet 20'. The gussets 71 and 73 are formed at about a 45° angle which is shown as angle $\theta$ in FIG. 4*b*. By way of example, the reinforced heater tab 10 is formed of 0.20 mm thick 304 stainless steel or nickel-iron. Each of the gussets 71 and 73 has a width of about 0.38 mm. The gussets 71 and 73 reinforce the tab 10' by strengthening the interconnection between the parts 14' and 16' of the main body portion 12' and the legs 22', and between the legs 22' and the attached feet 20'. The reinforced tab 10' is more rigid and resistant to transverse motion in the direction A'—A' than the conformal tab 10, and thus is less likely to permit a heater short resulting from contact between the parts 14' and 16'.

Figure 4C:
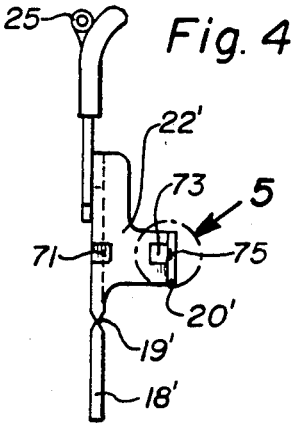
Figure 4B:
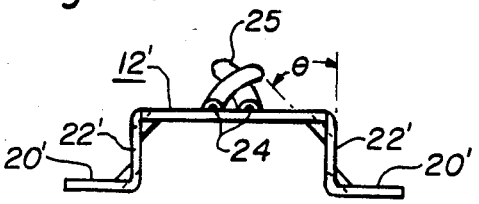
Figure 5:
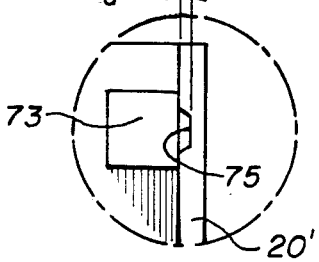
FIG. 5 is an enlarged view of the portion of the heater tab, shown within circle 5 of FIG. 4*c*.

The reinforced heater tab 10' also includes a stamped portion 75, shown in FIGS. 4*c* and 5, formed in one surface of each of the feet 20'. The stamped portion 75 extends for a distance d, of about 0.08 mm, into each of the feet 20' and flatten the feet to provide mechanical stability to the tab 10' without creating a protuberance on the opposite surface of each of the feet 20'. The flattening facilitates attachment of the feet 20' of the tab 10' to a plurality of heater bead straps 77 which are shown in FIG. 3. The heater bead straps 77 are embedded into the insulating support rods 41*a* and 41*b*. As shown in FIG. 3, the reinforced heater tabs 10' extend between oppositely disposed pairs of heater bead straps 77. The stamped portions 75 (shown in FIGS. 4*a*, 4*c* and 5) provide flat surfaces on the feet 20' to permit planar-to-planar contact between the feet 20' and the heater bead straps 77 and splash-free welding of the contacting components. The reinforced outer heater tabs 10', which are welded to the heater bead straps 77, provide a substantially rigid, box-like support structure for the attachment of the conformal center cathode heater tab 10. The conformal heater tab 10, associated with the center cathode 43*b*, is a compliant structure without the reinforcing gussets present in heater tabs 10'. The conformal heater tab 10 has one foot 20 attached to a leg 22' of one of the heater tabs 10' and the other foot 20 attached to a leg 22' of the other heater tab 10'. The conformal heater tab 10 associated with the center cathode 43*b* accommodates to the configuration of the reinforced heater tabs 10' without distorting the nested arrangement of the heater tabs 10 and 10'. After attachment of the conformal heater tab 10 to the reinforced heater tabs 10', the removal portions 18 and 18' (FIGS. 1*a* and 4*a*) are detached at the score lines 19 and 19' respectively. The orientation of the parts 14 and 16 of the conformal heater tab 10 in a plane substantially parallel to the planes of the support rods 41*a* and 41*b* minimizes the compression on the tab 10 and decreases the probability that the two parts 14 and 16 will experience a transverse motion that will cause the parts to contact one another. Accordingly, there is little likelihood that the nested heater tab structure of FIG. 3 will short-out.

What is claimed:

1. In an electron gun assembly for use in a cathode-ray tube, said gun assembly including a pair of insulating support rods, at least one indirectly heated cathode for generating an electron beam, said cathode being disposed between said support rods, a heater for said cathode, said heater having a pair of heater legs, a heater tab, strap means for attaching said heater tab to said support rods, and a plurality of electrodes for focusing and accelerating said electron beam, the improvement wherein said heater tab comprises a main body portion including a first and a second part, each of said parts being attached to a respective leg of said pair of legs of said heater, said heater tab having a pair of outwardly directed feet each of which is connected to a respective part of the parts of said main body portion by a pair of substantially orthogonal legs extending therebetween, said heater tab including primary reinforcing means comprising gussets formed therein, said gussets extending between said parts of said main body portion and said orthogonal legs, and also between said orthogonal legs and said feet to maintain the rigidity of said heater tab, wherein each of said feet of said heater tab includes secondary reinforcing means comprising a stamped portion formed into a surface thereof to flatten said feet to facilitate connection to said strap means and to provide stability to said heater tab.

2. In an electron gun assembly for use in a cathode-ray tube, said gun assembly including a pair of insulating support rods, three inline indirectly heated cathodes including a center cathode and two outer cathodes for generating three electron beams, attachment means for attaching said cathodes to said support rods, a heater for each of said cathodes, each of said heaters having a pair of heater legs, heater tab means attached to said heater legs, oppositely disposed pairs of heater bead straps for attaching the heater tab means to said support rods, and a plurality of electrodes for focusing and accelerating said electron beams, the improvement wherein the heater tab means comprises a pair of reinforced heater tabs associated with said outer cathodes and a conformal heater tab associated with said center cathode, each of said heater tabs having a main body portion including a first and a second part, each of said parts being attached to a respective part one leg of one of said heaters, each of said heater tabs having a pair of outwardly directed feet each being connected to one of the parts of said main body portion by a pair of orthogonal legs extending therebetween, said reinforced heater tabs including primary and secondary reinforcing means, said primary reinforcing means extending between said parts of said main body portion and said orthogonal legs, and also primary reinforcing means extending between said orthogonal legs and said feet to maintain the rigidity of said reinforced heater tabs, said secondary reinforcing means being formed into a surface of each of said feet to flatten said surface of said feet, said feet of said reinforced heater tabs being affixed to a different one of said oppositely disposed pairs of heater bead straps to provide a substantially rigid box-like structure, said feet of said conformal heater tab being attached to one of said orthogonal legs of each of said reinforced heater tabs, said conformal heater tab being disposed between said reinforced heater tabs.

3. The electron gun assembly as described in claim 2, wherein said primary reinforcing means comprises gussets formed in said reinforced heater tabs.

4. The electron gun assembly as described in claim 2, wherein said secondary reinforcing means includes a stamped portion which flattens said feet of said reinforced heater tabs to facilitate connection to said heater bead straps and provides stability to said reinforced heater tabs.

* * * * *

UNITED STATES PATENT AND TRADEMARK OFFICE
CERTIFICATE OF CORRECTION

PATENT NO. : 4,789,807

DATED : December 6, 1988

INVENTOR(S) : John R. Hale

It is certified that error appears in the above-identified patent and that said Letters Patent is hereby corrected as shown below:

Col. 1, line 49, after "cathode-ray" add --tube--.

Col. 2, line 50, change "name" to --named--.

Col. 4, line 60, delete "part one" and after "leg" add --of said pair of legs--.

Col. 4, line 62, delete "one" and add --a respective part--.

Signed and Sealed this

Twelfth Day of December, 1989

*Attest:*

JEFFREY M. SAMUELS

*Attesting Officer*

*Acting Commissioner of Patents and Trademarks*